United States Patent [19]

Iwahashi et al.

[11] 4,131,483

[45] Dec. 26, 1978

[54] METHODS FOR CLEANING ARTICLES WITH UPWARD FLOWING LIQUIDS

[75] Inventors: Shunji Iwahashi, Shinsenrikita; Masahiro Yamasaki, Ibaraki; Takanori Fujita, Takatsuki, all of Japan

[73] Assignee: Sumitomo Chemical Company, Limited, Osaka, Japan

[21] Appl. No.: 801,313

[22] Filed: May 27, 1977

[30] Foreign Application Priority Data

May 28, 1976 [JP] Japan ..... 51-62557
Jun. 1, 1976 [JP] Japan ..... 51-64965

[51] Int. Cl.[2] ..... B08B 3/12
[52] U.S. Cl. ..... 134/1; 134/10; 134/29; 134/30
[58] Field of Search ..... 134/1, 10, 25 R, 29, 134/30, 34

[56] References Cited

U.S. PATENT DOCUMENTS

| | | | |
|---|---|---|---|
| 2,647,846 | 8/1953 | Bagno | 134/1 |
| 2,961,354 | 11/1960 | Cleveland | 134/1 |
| 3,050,422 | 8/1962 | Zak | 134/1 |
| 3,661,660 | 5/1972 | Wessells et al. | 134/1 X |

*Primary Examiner*—Richard V. Fisher
*Attorney, Agent, or Firm*—Birch, Stewart, Kolasch and Birch

[57] ABSTRACT

Synthetic resin articles to be printed, plated or coated are cleaned prior thereto by carrying the articles into a cleaning zone where they are contacted with an aqueous detergent solution which is allowed to flow upward and to which an ultrasonic wave is applied, carrying the articles from the cleaning zone to a rinsing zone where they are contacted with warm water which is allowed to flow upward, carrying the articles from the rinsing zone to a dipping zone to contact them with more fresh warm water which is allowed to flow upward, and then pulling the articles up slowly from the dipping zone to drain off the water attached to the articles.

6 Claims, 13 Drawing Figures

METHODS FOR CLEANING ARTICLES WITH UPWARD FLOWING LIQUIDS

BACKGROUND AND SUMMARY OF THE INVENTION

The present invention relates to a method for cleaning synthetic resin articles and an apparatus for the method. More particularly, it relates to a cleaning method which is suitable for a treatment prior to printing, plating or coating of synthetic resin articles, producing surfaces having smoothness and no pinholes. Further, the present invention relates to a dip-coating apparatus for producing smooth coating films.

There are produced various kinds of synthetic resin articles which are either improved in appearance or changed in surface property by treatments such as printing, plating or coating. In these treatments, the cleanliness of surfaces to be treated is very important and it is not too much to say that the cleanliness exerts a decisive effect on the performances of the final products.

That is to say, the results of printing, plating and coating depend upon how to remove foreign substances from the surface of a substrate. When the foreign substances are not removed, they stay between the substrate surface and the printing, plating or coating film, and act to weaken the adhesion power between the surface and the film, or to promote the formation of pinholes or specks.

As the treatment prior to printing, plating or coating, various cleaning methods which use organic solvents, emulsion liquors, detergents, acids, or ultrasonic waves, are employed industrially. Of these methods, however, there are relatively few which are suitable for cleaning synthetic resin articles made of vinyl resins (e.g. polyvinyl chloride), acrylic resins (e.g. polymethyl methacrylate), styrene resins (e.g. polystyrene, acrylonitrile-styrene-butadiene terpolymers, acrylonitrile-styrene copolymers, methyl methacrylate-butadiene-styrene terpolymers) or polycarbonate resins. For example, in the solvent cleaning with an organic solvent such as benzene, gasoline, trichlene or perchloroethylene, it often occurs that the articles to be cleansed are dissolved in the solvent or produce cracking or blushing by contact with the solvent. Consequently, the solvent cleaning is improper for synthetic resins. The emulsion cleaning is also improper when these solvents are used, because the same problems as above occur. Further, the acid cleaning generally used for metals is also undesirable because it uses strong acids which easily do damage to the articles to be cleaned.

The detergent cleaning is relatively suitable for cleaning synthetic resin articles and it gives further desirable results when carried out with ultrasonic waves. When a detergent and ultrasonic waves are used together, dirt is removed from the surface of the articles, but the articles do not dissolve in the cleaning liquor nor produce cracking and blushing. When a detergent is used, it becomes necessary to completely remove the detergent from the surface of the articles. If the removal is insufficient, it results that adhesion between the surface and film becomes poor and surface smoothness is damaged. In addition, as the cleaning is carried out with water, drying after the cleaning is slow and dirt in the air easily adheres to the cleaned surface.

Next, it is well known that materials of relatively simple shape, for example, a flat plate, are coated by a method which comprises dipping them in a coating liquor and pulling them up slowly thereby forming a coating film on the surface. In this case, the coated surface forms a flat or relatively gentle curved surface so that, when foreign substances such as dust are present in the coating liquor, the poor smoothness of the coating film becomes readily noticeable. This becomes a serious problem when the coating film is thin. The foreign substances in the coating liquor include not only those contained in the liquor from the beginning, but also those produced by gelation or drying of a part of the liquor, those coming into the liquor from the atmosphere and those attached to the surface of articles to be coated.

In the so-called dip-coating process in which articles to be coated are dipped in a coating liquor and pulled up slowly whereby a coating film is formed thereon, it is generally the case that the articles are dipped in and pulled up from a stationary coating liquor. In this process, foreign substances in the liquor come into the coating film. In many cases, however, the smoothness of film surface is not much affected because, in general, the film thickness is relatively large, or the smoothness of film surface is not essential to the performances of the products. When the coating film is thin, the smoothness of film surface is adversely affected by foreign substances and thus its value as goods is largely damaged. The commonly used, well-known filtration process for removing dust from a coating liquor is as follows: a coating liquor is supplied to a dip-coating vessel at one side of the top (the term "top" means the continuous upper end of the surrounding wall of the vessel), allowed to flow on the surface layer of the liquor in the vessel and to overflow from the other side of the top. The liquor which overflows is filtered and circulated to the vessel. Foreign substances deposited on the bottom are discharged from the bottom. This process is suitable for preventing foreign substances in the atmosphere from entering the liquor, but once the foreign substances enter the liquor, those having a specific gravity close to that of the coating liquor and those of fine size are dispersed in the liquor without settling to the bottom. Consequently, they can not be removed.

An object of the present invention is to provide a detergent cleaning method which is free from the above-mentioned problems and at the same time suitable for printing, plating and coating of synthetic resin articles, and an apparatus therefor.

Another object of the present invention is to provide an apparatus which is capable of removing foreign substances which are difficult to remove when dispersed in a coating liquor, thereby providing a smooth coating film having very little unevenness.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention provides a method for cleaning synthetic resin articles, which comprises (1) carrying the articles into a cleaning zone where they are contacted with an aqueous detergent solution which is allowed to flow upward and to which an ultrasonic wave is applied, (2) carrying the articles from the cleaning zone to a rinsing zone where they are contacted with warm water which is allowed to flow upward, (3) carrying the articles from the rinsing zone to a dipping zone where they are contacted with more fresh warm water which is allowed to flow upward, and then (4) pulling the articles up slowly from the dipping zone to drain off the water attached to the articles. The present invention also provides an appartus for cleaning synthetic resin articles comprising a transporter capable of holding the articles to be cleaned and carrying them vertically and horizontally, an ultrasonic cleaning vessel having such a structure so as to provide an upward flow to an aqueous detergent solution, a rinsing vessel to which warm water is supplied through a filter and through which the warm water flows upward, and a dipping vessel to which warm water is supplied through a filter and through which the warm water flows upward (the dipping vessel hereinafter referred to as "draining vessel"), the cleaning vessel, rinsing vessel and draining vessel being placed in this order, and said articles to be cleaned being successively carried by the transporter from the ultrasonic cleaning vessel through the rinsing vessel to the draining vessel, and said articles being pulled up slowly from the draining vessel. Further, in a dipping apparatus for forming a coating film by carrying articles to be coated into a vessel to contact them with a coating liquor and pulling them up slowly, the present invention provides an improvement which comprises using a vessel having such a structure as to supply the coating liquor at the bottom and allow the liquor to flow upward through a perforated plate and to overflow the whole of the top, the vessel being equipped with an apparatus for circulating the coating liquor which overflows, and a filter for removing foreign substances from the liquor.

As the aqueous detergent solution, there may be used aqueous solutions containing a common detergent for cleaning, for example, anionic or nonionic surface active agents. As for the concentration of the detergent in water, a reasonable concentration is sufficient. Some detergents at times produce vigorous foaming and are poor in processability, when used in too high concentrations. When the concentration is lowered to less than a critical micelle concentration, the cleaning effect substantially decreases. In general, a preferred concentration is 0.5–10 g/liter of water. A preferred temperature of the aqueous detergent solution is about 20 to 50° C., and more favorably around 40° C.

The ultrasonic wave applied to the aqueous detergent solution can be generated by commonly used ultrasonic generators (e.g. frequency, 25–45 kilohertz; output, 0.5–2.0 Watt/cm$^2$).

As to the temperature of the warm water for rinsing off the detergents, the higher it is the more effective it is. But, the upper limit of the temperature is limited because synthetic resin articles are deformed by heat when the temperature is too high. The upper limit is determined by the thermal properties of the articles so that it depends upon the kind of synthetic resin and the processing condition. In general, however, one standard for determining the upper limit is a temperature of 10° C. lower than the heat distortion temperature of the articles, which is measured according to the test method specified by ASTM (American Society for Testing and Materials) D-648. A preferred temperature of the warm water for rinsing off detergents on synthetic resin articles molded by the usual conditions is within a range of 40 to 70° C. But, a temperature of 50 to 60° C. is more desirable to sufficiently remove the detergents with no deformation of the articles. When this warm water contains a substantial amount of dusts, the dusts adhere to the surface of the articles, and enter the warm water for the draining, so that they remain on the articles after drying. Consequently, warm water for the rinsing is, if necessary, filtered before it is supplied to the vessel.

As for the filter, commonly used filters are sufficient. A preferred filter is one of fine mesh, but filters having a mesh of less than 1$\mu$ in size are not desirable for practical purposes, because they are expensive and high in resistance to filtration, which leads to the enlargement of equipment used and an increase in equipment cost. On the other hand, the size of dust removed from synthetic resin articles depends upon the kind of treatments such as printing, plating and coating, and the thickness of coating film. In general, however, dust of more than 5$\mu$ in size should be removed. Consequently, filters having a mesh of 1 to 5$\mu$ on the average are preferred for filtering warm water for the rinsing process. Further, as to the quality of the warm water for rinsing off the detergents, water of such a quality that passes the quality standard of city water (authorized by Ministry of Health and Welfare) is sufficient. But, when superior surface smoothness and adhesion properties are particularly required, it is desirable to further lower the contents of the organic substance, chlorine and metal in water. Water having a required quality can be obtained using a sand filter, active carbon filter, ion-exchange filter, iron-removing equipment, manganese-removing equipment or combination thereof.

Additional fresh warm water used for dipping the articles before the water attached on the articles is drained off is used for removing a trace amount of detergent which may possibly remain on the surface of synthetic resin articles to be cleaned, and at the same time for preventing the attachment of dust to the surface and drying the surface rapidly by pulling up the articles slowly out of the fresh warm water. A higher temperature is therefore desirable for increasing the rate of drying, but it must not deform the articles as in the case of the warm water used for the rinsing process. One standard to determine the upper limit of the temperature is also a temperature 10° C. lower than the heat distortion temperature of the articles. When the heat distortion temperature of the articles is less than 70° C., the temperature of the water should be less than 60° C. In case of synthetic resin articles molded by the usual conditions, the temperature of the water is 60 to 70° C. The size of dust contained in this warm water is decreased to the same degree as, or less than, that of dust in the warm water for the rinsing of detergents. For the filters, those having a mesh of 1 to 5$\mu$, preferably 1 to 3$\mu$, in size are suitable for use. The quality of the warm water is of the same degree as or higher than that of the warm water for rinsing. Further, it is preferred that the articles are pulled up slowly out of the warm water, because water drops which remain on the surface of the articles are reduced and a uniform surface is easily obtained. However, the rate of pulling-up is increased with an increase in the temperature of the warm water. When the temperature is 60 to 70° C., the rate is 20–30 cm/min.

The articles cleaned by the method of the present invention give good results when they are dried and subjected to treatments such as printing, plating and coating. The coating can effectively be carried out using the present dipping apparatus which is hereinafter explained and is another object of the present invention.

Needless to say, the articles cleaned by a known method other than the present method can be coated using the dipping apparatus of the present invention.

The method and apparatus of the present invention will be explained in detail with reference to the accompanying drawings wherein:

FIG. 9(*b*) is a cross-sectional view of FIG. 9(*a*);

FIG. 10(*b*) is a cross-sectional view of FIG. 10(*a*); and

Throughout these figures, 1 is an air cylinder or hydraulic cylinder for vertical motion, 2 is an endless conveyor for carrying the synthetic resin articles to be cleaned, 3 is a hanger for holding the articles, 4 is an ultrasonic cleaning vessel, 5 is a rinsing vessel, 6 is a draining vessel, 7 is an ultrasonic generator, 8 is an overflow dam of the ultrasonic cleaning vessel, 9 is an overflow dam of the rinsing vessel, 10 is an overflow dam of the draining vessel, 11 is a cleaning liquor inlet, 12 is a warm water inlet, 13 is a warm water inlet, 14 is an aqueous cleaing solution outlet, 15 is a warm water outlet, 16 is a warm water outlet, 17 is a filter for warm water, 18 is a filter for warm water, 19 is a perforated plate, 20 is a circulating apparatus, 21 is a fresh liquor inlet and 22 is an old liquor outlet. Further, 23 is an overflow dam, 24 is a perforated plate, 25 is a circulating apparatus, 26 is a filter, 27 is a dipping vessel and 28 is a storage tank for coating liquor.

Figure 1:
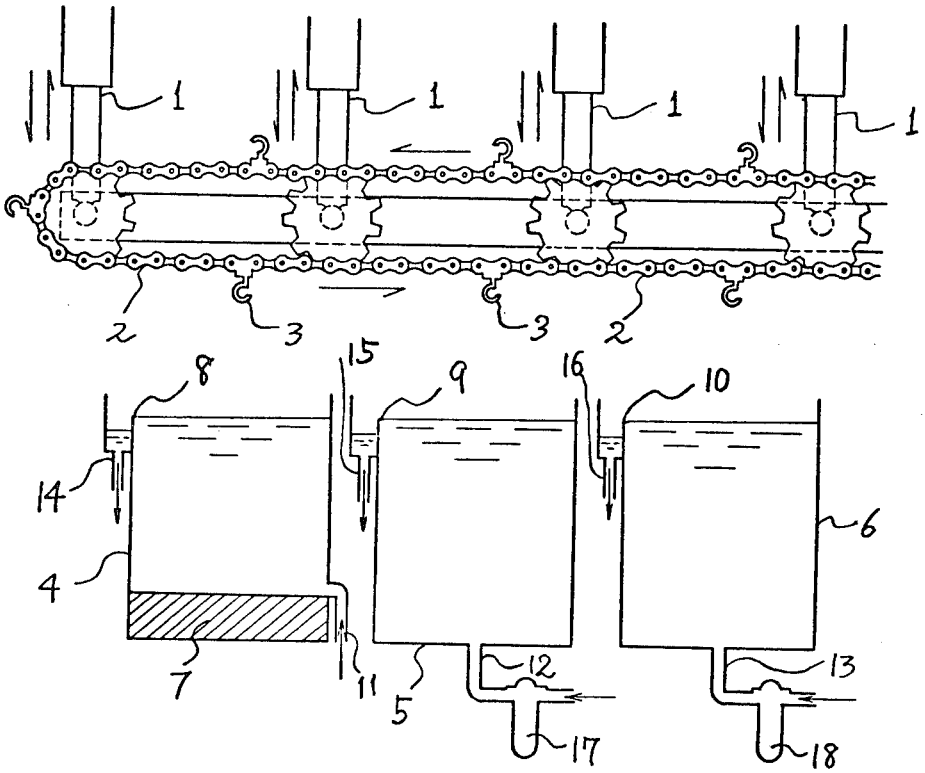
FIG. 1 is a schematic view of the apparatus for cleaning the articles.

More concretely, in FIG. 1, 1 is an air cylinder or hydraulic cylinder for vertically moving a feed gear for articles to be cleaned, and 2 is an endless conveyor for carrying the articles, which is equipped with a hanger 3 for holding a device to which one or more articles are fixed. Element 4 is an ultrasonic cleaning vessel equipped with an ultrasonic generator 7 disposed at the bottom. The vessel is constructed so that the aqueous cleaning solution enters the vessel through an inlet 11 at the bottom, flows upward in the vessel, and flows down from an overflow dam 8 to an outlet 14. Element 5 is a rinsing vessel and warm water passes through a filter 17 enters the vessel through an inlet 12 at the bottom, flows upward in the vessel, and flows down from an overflow dam 9 to an outlet 15. Element 6 is a draining vessel and warm water passes through a filter 18, enters the vessel through an inlet 13 at the bottom, flows upward in the vessel, and flows down from an overflow dam 10 to an outlet 16. Since a cleaning vessel 4, rinsing vessel 5, draining vessel 6, and filters 17 and 18 are always brought into contact with water, it is preferred to make them of anti-corrosive materials and, if necessary, to cover them with heat-insulating materials. The suitable anti-corrosive materials include anti-corrosive metals (e.g. stainless steel) and synthetic resins.

Figure 2:
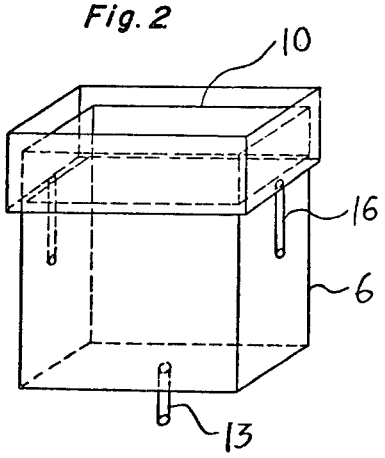
FIG. 2 is a perspective view of a vessel in which a liquor overflows the vessel over the whole of the top.
Figure 3:
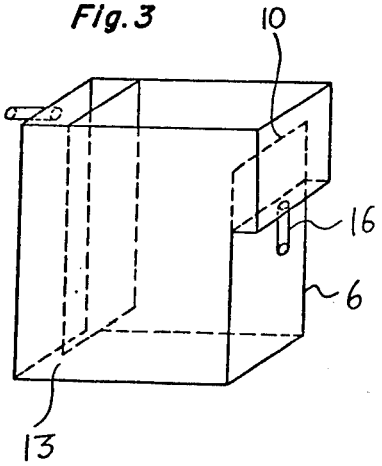
FIG. 3 is a perspective view of a vessel in which a liquor overflows the vessel at a part of the top.

The overflow dam may be mounted either on the whole or a part of the top of the vessel. FIG. 2 shows a draining vessel with an overflow dam mounted on the whole of the top. The flow of liquor becomes more uniform by this mechanism of overflow. FIG. 3 shows a draining vessel, as one example, with an overflow dam mounted on a part of the top. In this vessel (FIG. 3), an inlet 13 is widened at the bottom, that is, warm water is first fed to the upper part of the left side and then enters the vessel through a wide inlet 13 at the lower part. Such a mechanism of warm water supply is more desirable for the purpose of draining because air bubbles can be removed from warm water so well that warm water entering the vessel through an inlet 13 contains no air bubbles. Further, it is often difficult to keep the whole of the top of the vessel at the same level, and therefore it is very effective to make the shape of an overflow dam wave-like, because a uniform overflow becomes possible even if the level is somewhat different. The above-mentioned dam is very effective in making the upward flow of liquor uniform in the ultrasonic cleaning vessel, rinsing vessel and draining vessel.

Figure 4:
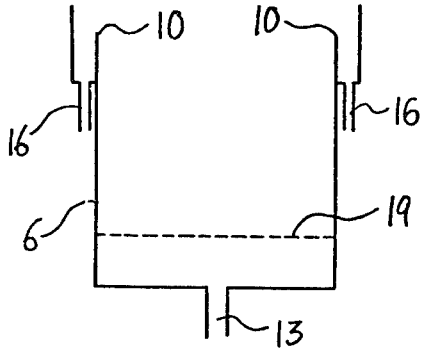
FIG. 4 is a cross-sectional view of a vessel in which a liquor overflows the vessel at the whole of the top and a perforated plate is located in the lower part.
Figure 5:
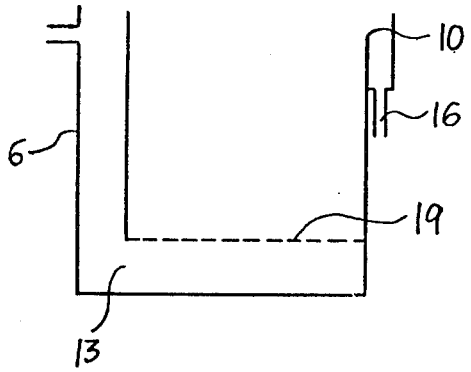
FIG. 5 is a cross-sectional view of a vessel in which a liquor overflows the vessel at a part of the top and a perforated plate is located in the lower part.

FIG. 4 and FIG. 5 show cross-sections of the draining vessels having a perforated plate at the lower part. In FIG. 4, 19 is a perforated plate and warm water entering the vessel at an inlet 13 flows upward through this plate. By setting up a perforated plate 19, the upward flow of liquor becomes more uniform and the effect of rinsing off a detergent is further increased. FIG. 5 shows the state wherein a perforated plate is mounted on the lower part of the vessel shown in FIG. 3. The upward flow of liquor becomes more uniform by this mechanism. Installment of perforated plates is very effective for making uniform the upward flow of liquor in a draining vessel and rinsing vessel. The perforated plate suitable for use includes perforated anti-corrosive metal plates (e.g. stainless steel plate) and synthetic resin plates, and communicating porous plates produced by sintering the fine powder or small particle of anti-corrosive metals or synthetic resins. The diameter of pore may be 100$\mu$ to 20 mm, preferably 600$\mu$ to 10 mm, and the plates having a porosity of 10 to 50% are suitable because they are relatively low in pressure loss and act to uniformalize the flow of liquor.

Figure 6:
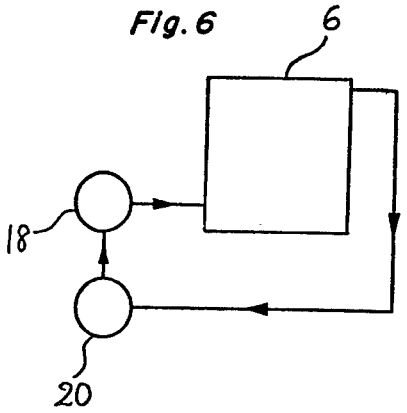
FIG. 6 is a flow sheet showing the flow of liquor when the whole liquor is circulated.
Figure 7:
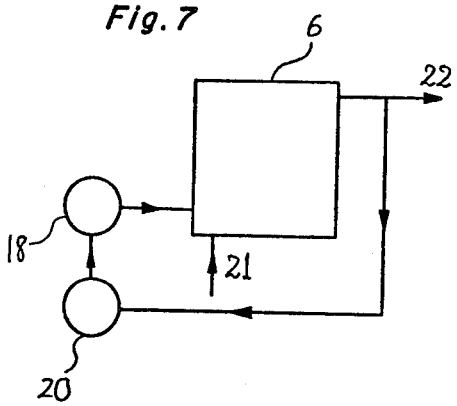
FIG. 7 is a flow sheet showing the flow of liquor when a part of the liquor is discharged and fresh liquor is supplied.

FIG. 6 is a flow sheet showing the flow of warm water in a draining vessel combined with a circulating apparatus 20. Warm water coming out of a draining vessel 6 is sent to a filter 18 by means of a circulating apparatus 20 and is again supplied to the draining vessel. This circulation system is employed to reuse the aqueous detergent solution, warm water for the washing vessel and warm water for the draining vessel. If necessary, it is effective to discharge a waste liquor while supplying a fresh liquor. That is, referring to the flow sheet of FIG. 7 which shows the flow of warm water in a draining vessel combined with a circulating apparatus 20, a part of the waste warm water coming out of a draining vessel 6 is discharged at an outlet 22 and the remainder is circulated, while fresh warm water is supplied at an inlet 21. By employing this circulation system, the liquor is effectively used, dust can be removed from water with a high efficiency, and the treatment of water quality can be carried out at a low cost. In employing this circulation system, it is particularly necessary to maintain the water temperature in a suitable range and this may be attained by combining with heating apparatus.

In the untrasonic cleaning vessel, rinsing vessel and draining vessel of the present invention, it is desirable to properly select the rate of the upward flow of liquor and the rate is changed depending upon the cleaning (rinsing) time as well. When the cleaning (rinsing) time is short, a relatively high rate is preferred. The typical examples of average rate are 5–500 mm/min, 100–1000 mm/min and 50–500 mm/min for the ultrasonic cleaning vessel, rinsing vessel and draining vessel, respectively.

Figure 8:
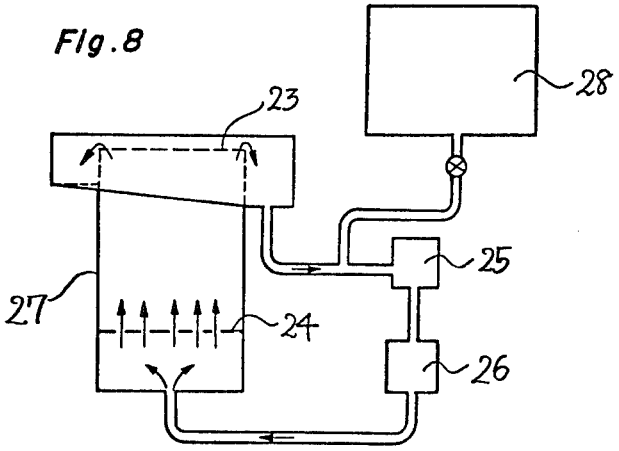
FIG. 8 is a schematic diagram showing one embodiment of the dipping apparatus.

In the dipping vessel of the present invention in FIG. 8, a coating liquor inlet is set at the bottom of a dipping vessel 27, and a coating liquor supplied to the inlet passes through a perforated plate 24 which acts to render uniform the flow of liquor, flows upward and uniformly in the vessel, and overflows a dam 23 mounted on the top of the vessel. The liquor which overflows is collected at a circulating apparatus 25 and set to a filter 26 therefrom in order to remove foreign substances from the liquor. The coating liquor passed through a filter 26 is again supplied to a dipping vessel 27 at the inlet of the bottom. In this manner, the circulation of liquor is repeated. If necessary, the circulation system may be connected with a storage tank 28 for coating liquor. Further, desirable results can be obtained by furnishing the dipping vessel and piping system with heating and cooling equipment and heat-insulating barriers which are useful for controlling the temperature of the coating liquor.

The dipping apparatus of the present invention is characterized in that it is constructed so as to allow the whole liquor to circulate therethrough. For this purpose, the flow of liquor is changed from the conventional horizontal flow (the liquor which enters flows on the surface layer of the coating liquor in the vessel) to the vertical flow (from bottom to top), and a perforated plate is mounted on the vessel to minimize local stagnation and uneven rate of low.

The dipping apparatus of the present invention is used for applying common surface-coating agents (e.g. paints, coating agents, surface-treating agents) and primers used prior to the application of these surface-coating agents. The superiority of the dipping apparatus of the invention is particularly remarkable when the size of foreign substances becomes a consideration, as the thickness of coating film is small.

Figure 9A:
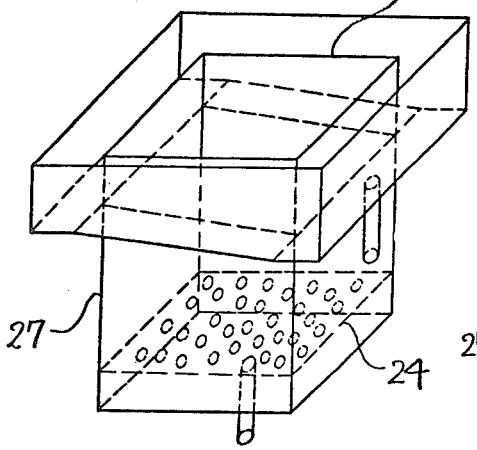
FIG. 9(*a*) is a perspective view of a dipping vessel in which a liquor overflows the vessel over the whole of the top.
Figure 10A:
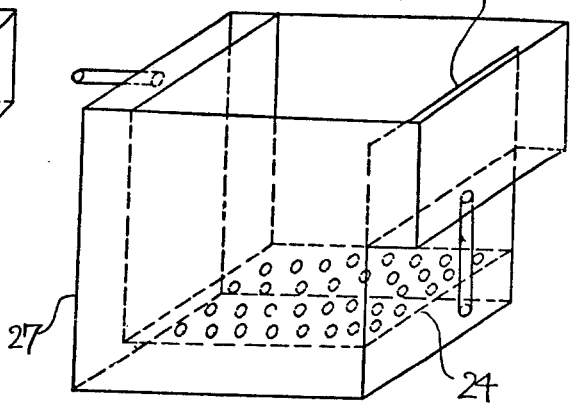
FIG. 10(*a*) is a perspective view of a dipping vessel in which a liquor overflows the vessel at one side of the top.
Figure 9B:
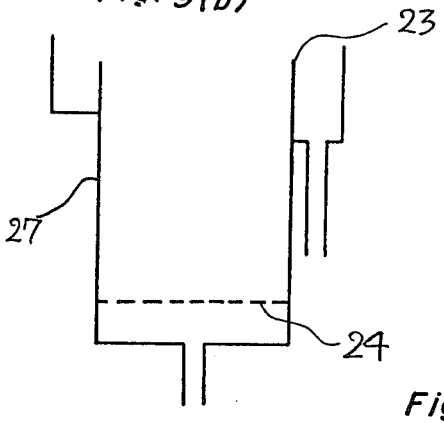
Figure 10B:
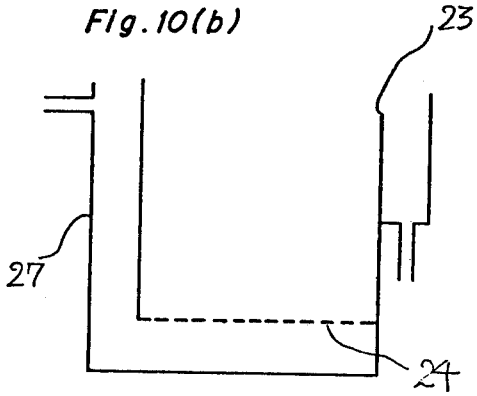

As to the flow of liquor over the top of the dipping vessel, it becomes more uniform when the liquor overflows over the whole of the top, as shown in FIG. 9(*a*) and FIG. 9(*b*). But, uniform circulation of liquor can be attained even when the liquor overflows over only a part of the top, as shown in FIG. 10(*a*) and FIG. 10(*b*).

Figure 11:
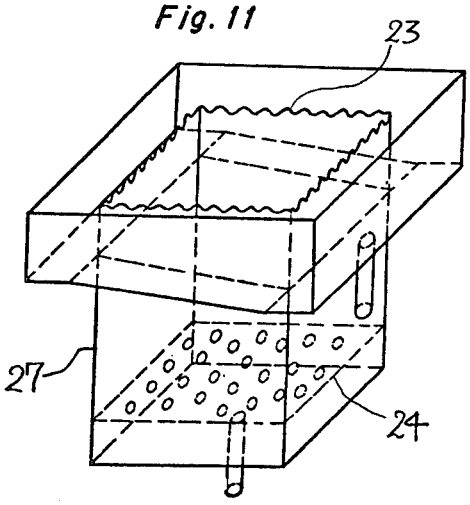
FIG. 11 is a perspective view of a dipping vessel having a wave-like overflow dam.

Referring to the shape of the overflow dam, when the whole of the top is used as a overflow dam, it is difficult to keep the whole dam at the same level and therefore it is difficult to ensure the uniform flow over the whole dam. The wave-like dam as shown in FIG. 11 is effective for uniform overflow in this respect, because it gives some allowance to the level of the dam.

The higher the rate of flow in the vessel, the more times the liquor circulates and the larger the amount of dust removed. But, the surface of the coating liquor becomes turbulent and a smooth coating surface becomes difficult to obtain. Consequently, it is necessary to employ a proper rate depending upon the composition of coating liquors, the shape of vessels and the film thickness required.

The perforated plate for the dipping apparatus of the present invention may be made of various materials by various methods. For example, perforated plates of metals, inorganic substances (e.g. glass) and synthetic resins, and those produced by sintering the fine powder or granule of metals, inorganic substances (e.g. glass) and synthetic resins, are suitable. Particularly preferred ones are those produced by sintering, because they are low in pressure loss and produce a uniform flow. When the pressure loss becomes a particular problem, nonwoven fabric-like piles of metallic fibers, inorganic fibers (e.g. glass fibers) or synthetic resin fibers, or sintered products thereof are effective.

The filter of the present invention may be any of those used for the usual filtration but the size of mesh is selected depending upon the thickness of the coating film. For example, when the thickness of dried coating film is about 10$\mu$, the size of mesh is such that foreign substances of at least 3$\mu$ in particle size can be filtered off.

As to the circulating apparatus of the present invention, conventionally used ones, for example, pumps are used. The circulating equipment is selected depending upon the pressure loss of the filter and the amount of circulation which is determined by the composition of the coating liquor, the shape of vessel and the thickness of coating film. The materials for dipping vessels, perforated plates, filters, circulating equipment and pipes, which constitute the dipping system of the present invention, is selected among those having no interaction with a coating liquor. Generally, stainless steel, glass, synthetic resin and ceramics are used alone or in combination. Further, since the apparatus of the present invention is used for a smooth coating film, it is often desirable to pull up the coated articles slowly from the dipping vessel in order to minimize the thickness distribution. The rate at which the coated articles are pulled up depends upon the composition of coating liquor, but the rate is generally 5–100 cm/min. Further, it is desirable that the atmosphere in which the coating is carried out is kept clean, and it is more preferred to use the apparatus of the present invention in a place furnished with equipment for removing dust from the air.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for cleaning synthetic resin articles, which comprises (1) carrying the articles into a cleaning zone where they are contacted with an aqueous detergent solution which is allowed to flow upward and to which an ultrasonic wave is applied, (2) carrying the articles from the cleaning zone to a rinsing zone where they are contacted with warm water which is allowed to flow upward, (3) carrying the articles from the rinsing zone to a dipping zone where they are contacted with additional fresh warm water which is allowed to flow upward, and then (4) pulling the articles up slowly from the dipping zone to drain off the water attached to the articles, the average rates of the upward flow in steps (1), (2), and (3) being 5 to 500 mm/min, 100 to 1000 mm/min and 50 to 500 mm/min, respectively.

2. The method according to claim 1, wherein the temperature of the warm water in the steps (2) and (3) is about 10° C. lower than the heat distortion temperature of the synthetic resin articles.

3. The method according to claim 1, wherein the rate of the pulling is 20 to 30 cm/min at a warm water temperature of 60 to 70° C.

4. A method for cleaning synthetic resin articles, which comprises (1) carrying the articles into a cleaning zone where they are contacted with an aqueous detergent solution which is allowed to flow upward and to which an ultrasonic wave is applied, (2) carrying the articles from the cleaning zone to a rinsing zone where they are contacted with warm water which is allowed to flow upward, (3) carrying the articles from the rinsing zone to a dipping zone where they are contacted with additional fresh water which is allowed to flow upward, and then (4) pulling the articles up slowly from the dipping zone to drain off the water attached to the articles, the rate of pulling being 20 to 30 cm/min at a warm temperature of 60° to 70° C.

5. The method of claim 4 wherein the average rates of the upward flow in the steps (1), (2), and (3) are 5 to 500 mm/min, 100 to 1000 mm/min, and 50 to 500 mm/min, respectively.

6. The method according to claim 4, wherein the temperature of the warm water in the steps (2) and (3) is about 10° C. lower than the heat distortion temperature of the synthetic resin articles.

* * * * *